United States Patent [19]

Leidel

[11] Patent Number: 4,709,862

[45] Date of Patent: Dec. 1, 1987

[54] METHOD OF RECLAIMING GREEN SAND

[76] Inventor: Dieter S. Leidel, R.R. No. 5, Barrie, Ontario L4M 4S7, Canada

[21] Appl. No.: 8,748

[22] Filed: Jan. 30, 1987

[51] Int. Cl.[4] ..... B02C 19/12

[52] U.S. Cl. ..... 241/23; 164/5; 241/24; 241/DIG. 10

[58] Field of Search ..... 164/5, 412; 432/14; 134/2; 241/23, 65, DIG. 10, 30, 24

[56] References Cited

U.S. PATENT DOCUMENTS

| | | | |
|---|---|---|---|
| 1,205,323 | 11/1916 | Cady | 241/DIG. 10 X |
| 2,309,036 | 1/1943 | Beardsley | 241/DIG. 10 X |
| 2,456,769 | 12/1948 | Christensen et al. . | |
| 2,478,461 | 8/1949 | Connolly | 241/DIG. 10 X |
| 2,515,194 | 7/1950 | Christensen . | |
| 2,863,191 | 12/1958 | Dietert et al. . | |
| 3,312,403 | 4/1967 | Zifferer . | |
| 3,871,438 | 3/1975 | Vissers et al. . | |

FOREIGN PATENT DOCUMENTS

| | | |
|---|---|---|
| 2651154 | 12/1977 | Fed. Rep. of Germany . |
| 3103030 | 8/1982 | Fed. Rep. of Germany . |

OTHER PUBLICATIONS

D. Lawson and D. S. Leidel, Reclaimed Shakeout Sand as New Sand Substitute in Green Sand Molding Lines, AFS Transactions 84–28.

*Primary Examiner*—Mark Rosenbaum

*Attorney, Agent, or Firm*—Bean, Kauffman & Bean

[57] ABSTRACT

A method for reclaiming green sands having a wide range of moisture and temperature conditions involves processing such sands in a single reclaimer unit to produce free flowing reclaimed sand adapted to pass through a 20 mesh screen and having a temperature preferably no greater than about 120° F. The method involves effecting attrition of a batch of molding sand supplied to the reclaimer unit, applying a vacuum exhaust to the unit primarily to remove a calcined clay binder and water vapor therefrom, sensing the means temperature of the sand, and selectively adding moisture or heat to the sand as required to produce reclaimed sand having predetermined moisture and temperature conditions allowing such sand to be immediately screened of extraneous materials and passed to a mulling device or remixer. The rate of addition of moisture, if any, and the flow of exhaust air through the unit are controlled in order to prevent condensation in the exhaust conduit and dust collection devices.

9 Claims, 2 Drawing Figures

METHOD OF RECLAIMING GREEN SAND

BACKGROUND OF THE INVENTION

The present invention relates to the reclaiming of green sand used in metal casting operations.

Green sand is a mixture of sand, clay and water used in the formation of molds into which molten metals are poured and allowed to cool sufficiently to permit a molded metal object to be removed therefrom without injury. Typically, green sand has a moisture content of between 3% and 4% and a clay content of between 5% and 12% by weight of sand with the moisture and clay being essentially uniformly distributed throughout the body of the mold prior to the introduction of metal.

After the introduction of molten metal into a mold formed of green sand, the metal slowly solidifies giving off heat to the mold, which serves to heat the sand and partially evaporate moisture, which escapes from the mold into the environment as water vapor, with heating effects within the mold being progressively less in directions away from the molding cavity. As by way of illustration, heating of the mold in an inner region thereof immediately adjacent the mold cavity will be sufficient to both evaporate all free moisture present and heat the binder surrounding the sand grains above a critical temperature at which it loses its water of hydration and becomes deactivated or "dead burned", such that it cannot thereafter reabsorb water for purposes of binding sand grains together during a subsequent molding operation. In a next outer region, the heat imparted to the mold will be sufficient to effect drying of the binder, while permitting same to be reactivated by the subsequent addition of water, and finally in more remote regions heating will be such that only a portion of the moisture content may be lost.

It is generally accepted that the types of clays typically used as binders in foundry applications become fully deactivated when exposed to temperatures exceeding about 600° C. and can be fully reactivated by the subsequent addition of water when exposed to temperatures less than about 300° C. Clay binders exposed to temperatures intermediate 300° C. and 600° C. are partially deactivated or damaged for subsequent molding purposes, but can be partially reactivated.

After solidification of a metal casting, the casting is separated from the molding sand by a shakeout device and the sand collected for further use. During shakeout, differently heated portions of molding sand are randomly mixed, such that it is not possible to remove sand bearing deactivated binder from remaining portions of the used molding sand having binder coatings, which remain activated or are at least partially subject to reactivation. Reuse of such molding sand without the removal of deactivated binder and the addition of new binder, would eventually render the molding sand unfit for purposes of making molds. To prevent this, it has been common practice to add at the completion of each molding cycle a predetermined percentage of new sand and clay and to remove an identical amount of old molding sand from the sand system. An obvious disadvantage of this procedure, is that a part of the discarded molding sand will comprise sand and active binder or binder subject to reactivation and a part of the molding sand retained for reuse will contain deactivated binder. Moreover, the raising costs associated with obtaining new sand and binder to replace discarded moldingsand and with disposal of the discarded molding sand in landfill sites renders this accepted procedure uneconomical in many regions of the world.

A variation or modification of the above described practice is proposed in an article by D. Lawson and Applicant entitled, "Reclaimed Shakeout Sand As New Sand Substitute in Green Sand Molding Lines", appearing in AFS Transaction 84-28, wherein sand processed in a reclaimer of the general type described in pending U.S. patent applicantion Ser. No. 720,129, filed Apr. 5, 1985, but without the addition of heat, is substituted for upwards of 80% of an otherwise required new sand addition. In this procedure, a batch of old molding sand, which would have previously been withdrawn from the sand system and discarded, is subjected to attrition in the presence of a vacuum exhaust for a period of time determined to maximize the amount of calcined binder separated from the sand grains and removed from the batch, while minimizing the amount of activated binder so separated and removed. The processed batch, together with a small amount of new sand and binder, are then mixed wtih unprocessed molding sand from which the batch had originally been withdrawn and then sufficient water is added to the resultant sand system in a mulling device, as required to increase its moisture content to a level suitable for a subsequent molding operation.

Certain problems are inherent in processing a sand system in accordance with the above described practice, including its modified form, due to the non-uniformity of moisture and thermal conditions existing both within individual molds, particularly when molds have a large sand to metal weight ratio, and between molds served by the sand system, which occurs under actual foundry conditions when molding sand is shaken from both hot molds into which molten metal had been poured and cold molds, which for some reason, such as damage to the mold, have not been charged with molten metal.

As regards moisture content, sand from cold molds, as well as sand from remote regions of hot molds having a large sand to metal weight ratio, have or may have a moisture content exceeding about 1.5% at which the molding sand tends to be "sticky" and will blind fine 20 mesh screens preferred to be employed to remove foreign objects and agglomerates from molding sand prior to its reuse. As by way of example of this problem, a study conducted in a steel foundry determined that the mean moisture content of 48 samples of molding sand taken over a 30-day period was about 0.85%, which is sufficiently low to guarantee that molding sand will be free flowing through a 20 mesh screen. However, four occurrences were noted during this period in which moisture content exceeded 1.5%, such that blinding of a 20 mesh screen would occur, and thus disrupt the sand reclaiming process.

As regards temperature variations present in a sand system after shakeout, it is known that the "compactability" for mold forming purposes of molding sand having a correct moisture content falls off sharply above about 120° F. In the above study, the temperature of the samples fluctuated over a wide range with a mean temperature determined to be about 146° F. The most simple approach to the problem of reducing the temperature of molding sand is that of storing the sand in suitable storage bins or hoppers, but this approach is extremely time consuming and requires substantial investment in storage facilities. It has also been proposed to reduce the temperature of molding sand by passing relatively cool air therethrough and by the addition of water. While these latter approaches are employed, difficulties may nonetheless be encountered, due to wide temperature variations within the sand system, which may result in the removal of an excessive amount of fines including active binder and the introduction of excessive moisture tending to render portions of the sand system non-free flowing for screening purposes, respectively.

An alternative procedure is to process the whole or part of a sand system under heat and attrition conditions sufficient to effect complete removal of all binder and moisture from the sand system in order to produce "clean", free flowing sand to which new binder and water is then added. However, in the absence of controlled thermal processing of the sand system in accordance with the teachings of the above-mentioned patent application, costs involved in heating used molding sand and subsequent cooling of "clean" sand is economically prohibitive.

SUMMARY OF THE INVENTION

The present invention is directed to a process for reclaiming green sand; and more particularly to a process, which may be employed to process the whole or part of a sand system in a manner serving to place same in condition allowing for its essentially immediate reuse.

In accordance with the present invention, a sand system, which may have a wide range of moisture and temperature conditions, is processed in batches or discrete portions and in a manner allowing for the production of reclaimed sand, which is both free flowing for screening purposes and has a temperature in the range of about 120° F. and below. Processing is accomplished in a reclaiming unit in which the batches of the molding sand are successively subjected to one of three procedures or operations, namely, (1) attrition combined with air cooling without the addition of water, (2) attrition combined with air cooling with the addition of water, and (3) attrition combined with initial heating and subsequent air cooling without the addition of water. The specific operation to be performed is determined by the temperature of the portion of the sand system placed in the reclaiming unit. The flow of air and the rate of addition of water are controlled to prevent the formation of condensation in exhaust ducts connecting the reclaimer with a dust separating/collection unit.

An important feature of the present invention is that it permits production in a single unit of free flowing reclaimed sand having consistent moisture and temperature characteristics, so as to enable a mulling device to operate at some maximum predetermined efficiency.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
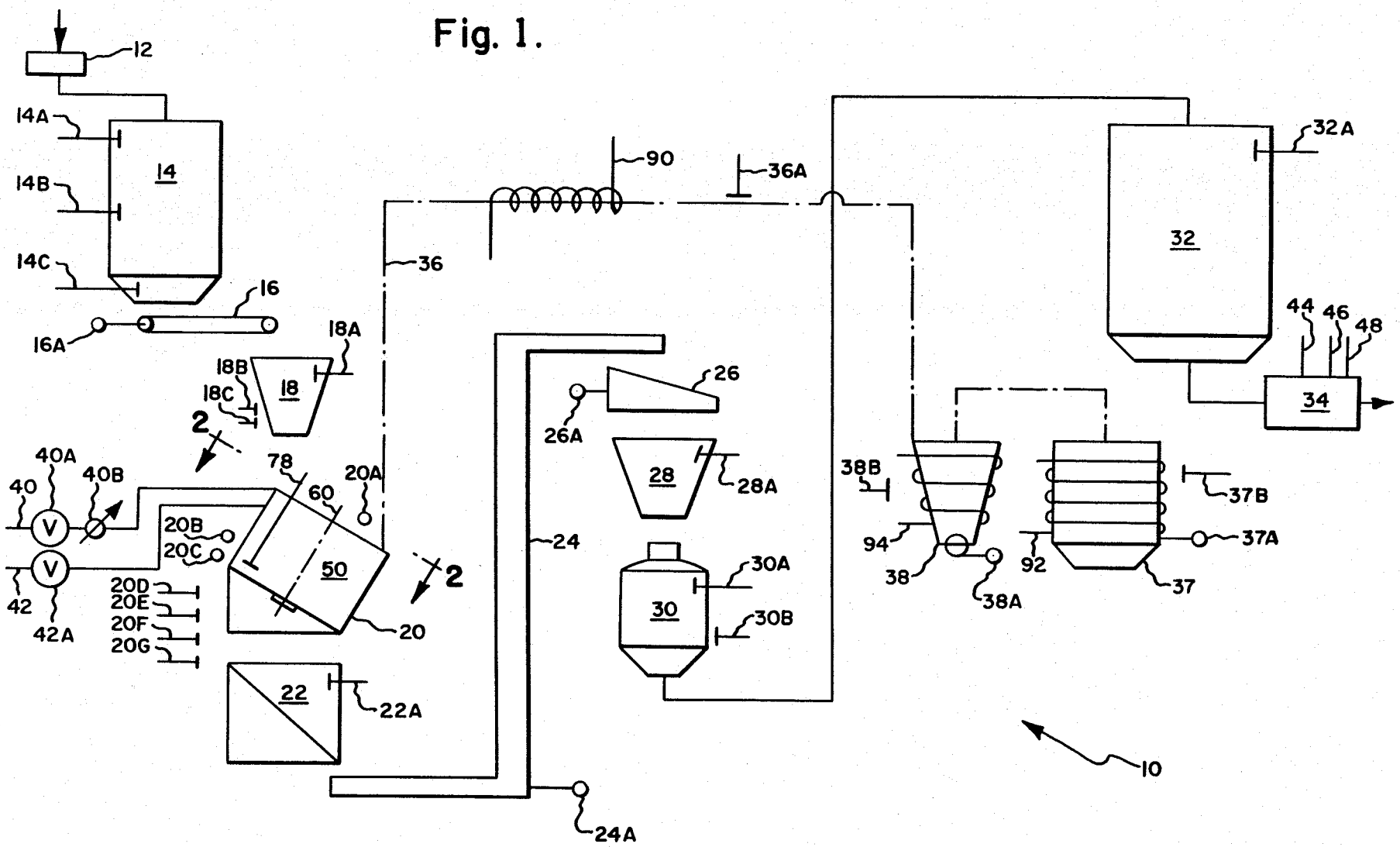
FIG. 1 is a diagrammatic view of a green sand reclaiming system incorporating the present invention.

A green sand reclaiming system formed in accordance with the present invention is designated as 10 and shown in FIG. 1 as generally comprising serially interconnected components in the form of a source of used green sand, such as defined by a mold shakeout device 12; a primary sand storage bin 14; a belt conveyor 16; a batch hopper 18; a reclaimer 20; a receiving hopper 22; a bucket elevator 24; a sand screening device 26; a receiving hopper 28; a pneumatic sand conveyor device 30; a sand storage bin 32; and a mulling or mixing device 34. System 10 also includes a conduit 36 connected into reclaimer 20 for use in exhausting air therefrom for delivery to a bag or other suitable dust filter 37 via a cyclone separator 38; conduits 40 and 42 for delivering water and fuel/air mixture, respectively, to reclaimer 20; and conduits or devices 44, 46 and 48 for delivering new clean sand, binder and water, respectively, to mulling device 34. A magnetic separation device, not shown, would normally be positioned between shakeout device 12 and storage bin 14 when system 10 is used in reclaiming sand used in molding ferrous metals.

Sand supplied to the system 10 is susceptible to having a relatively wide range of moisture and temperature conditions and is typically contaminated with calcined binder, small sand agglomerates in the form of sintered sand grains, and non-silica particles including ceramic particles from cores and riser sleeves and metal particles, which cannot be removed by magnetic separation techniques. It is desirable that sand, as delivered from the system to mulling device 34, be as free as possible from calcined binder, while retaiing a maximum amount of active binder; cooled to a consistent, relatively low temperature at which it can be properly compacted; fully particulated by the break down of sand agglomerates; and be free of non-silica particles.

In accordance with the present invention, the functions of removal of calcined binder, temperature control of the sand and particulation of sand agglomerates is effected in reclaimer 20, whereas the function of removal of non-silica particles, together with any remaining small sand agglomerates, is effected by screening device 26, which normally includes a fine screen slightly coarser than the coarsest sand grain contained in the molding sand. As by way of example, a 20 mesh screen would be employed for most foundry sands, which contain 30 mesh grains as their largest size grain. In order that screening device 26 may function properly, it is necessary for reclaimer 20 to additionally function to insure that the moisture content of sand discharged therefrom be consistently maintained at less than a predetermined value at which sand would be sufficiently sticky to result in binding of a given mesh screen. Thus, for example, where a 20 mesh screen is to be employed, moisture content of sand discharged from reclaimer 20 would preferably not exceed about 1.5%.

The several components of system 10 are individually known and commercially available for use in the foundry industry, except that the construction and mode of operation of known reclaimer 20 has been modified in accordance with the present invention to permit all required functions, except for the screening operation, to be carried out quickly and almost simultaneously in a single unit.

Figure 2:
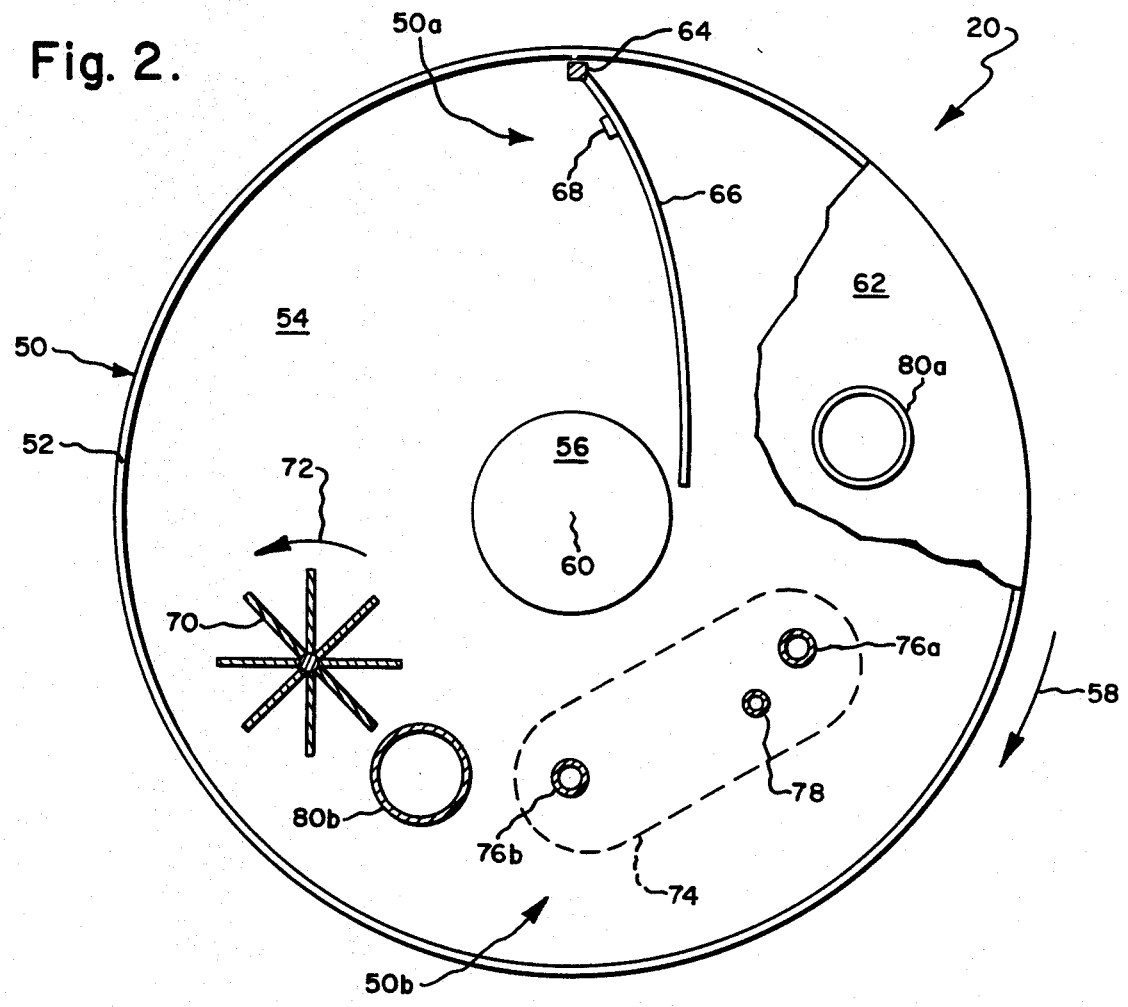
FIG. 2 is a top plan view of a reclaimer unit taken generally along the lines 2—2 in FIG. 1.

Reference is now made to FIGS. 1 and 2, wherein reclaimer 20 is shown as including an open topped, rotatable container 50 provided with a cylindrical side wall 52 and bottom wall 54 having a centrally located discharge closure 56, wherein the container is supported for rotation in the direction indicated by arrow 58 about a vertically inclined or tilted axis 60, so as to define relatively upper region 50*a* and lower region 50*b* within the container; and a non-rotatable or relatively stationary top closure or top wall 62, which is removable or provided with access closures, not shown, communicating with the discharge of batch hopper 18 to permit the introduction into the reclaimer of a batch of sand to be processed. Reclaimer 20 also includes a stripping device in the form of a straight stripping bar 64 arranged to depend downwardly within the upper region 50*a* immediately adjacent container side wall 52 for purposes of stripping or separating sand from the side wall, as container 50 rotates, and directing same laterally within the container and downwardly towards lower region 50*b;* a curved stripping bar 66 attached to a lower end of the straight stripping bar and arranged to lie closely adjacent container bottom wall 54 for purposes of assisting in the discharge of sand from the reclaimer when closure 56 is removed or opened; a temperature sensing device 68 suitably mounted, such as on the curved stripping bar for purposes of sensing the temperature of separated sand passing between upper region 50*a* and lower region 50*b;* a rotary impeller or crusher 70 driven for rotation in a direction indicated by arrow 72 about an axis disposed parallel to axis 60 for purposes of propelling sand towards and into the sand stripped from the side wall by the stripper bar, so as to create a region of turbulent sand 74 within lower region 50*b;* at least one and preferably a pair of burner nozzles 76*a* and 76*b* connected to conduit 42 for directing heating flame(s) downwardly into the container and into the region of turbulent sand; a nozzle 78 connected to conduit 40 for directing a stream of water downwardly into the container and into the region of turbulent sand; and at least one end preferably two exhaust ducts 80*a* and 80*b* opening downwardly into the container. The size and shape of the region of turbulent sand will vary to some degree upon the size of container 50, the size and placement of impeller 70 and the speeds at which same are driven.

If stripping bar 64 is assumed to occupy a 12 o'clock position within container 50, then it is preferable that impeller 70 would occupy approximately an 8 o'clock position; nozzles 76*a* and 76*b* would occupy approximately 4 o'clock and 6 o'clock positions, respectively; water nozzle 78 would occupy approximately a 4:30 o'clock position; and exhaust ducts 80*a* and 80*b* would occupy approximately 2:30 o'clock and 7 o'clock positions, respectively. Stripping bar 64, impeller 70, nozzles 76*a*, 76*b* and 78 and ducts 80*a* and 80*b* are suitably supported and extend through top closure 62. The construction of reclaimer 20 differs primarily from that described in pending U.S. application Ser. No. 720,129, by the inclusion of temperature sensor 68 for sand treatment control purposes and water nozzle 78 and its mode of operation to be described.

The size of reclaimer container 52 and the speed of rotation of such container and impeller 70 will depend upon the weight of a charge of sand to be processed. As by way of example, for a charge of silica sand of between 700 and 800 pounds, container 52 would preferably have a diameter of 43.3 inches, a height of between 28 and 30 inches and a peripheral or side wall speed of between 5 and 6 feet per second; and impeller 70 would preferably have a tip or peripheral speed of between 60 and 75 feet per second and as large a diameter as practical for the size of the container in order to minimize the rpm at which the impeller is required to be driven. This relationship has been found to provide for fast and efficient attrition of the molding sand as a result of sand to sand contact within the region of turbulent sand and impact of the sand on the impeller. The term attrition, as used herein, refers to the removal of binder from the surfaces of the individual sand grains and the particulation or reduction of sand agglomerates, as a result of abrasion/impact forces.

While the components of system 10 may be subject to manual control, it is preferble to provide for automatic, computer controlled operation of the overall system and to this end, the following sensor and control elements would preferably be provided in combination with a programmable, operation control computer, not shown. Specifically, storage bin 14 would have probes 14A, 14B and 14C for purposes of sensing/indicating the level of molding sand temporarily retained therewithin; conveyor 16 would be driven by a motor 16A; batch hopper 18 would have a high level probe 18A and discharge gate closed and open limit switches 18B and 18C, respectively; reclaimer 20 would have an impeller drive motor 20A, a container drive motor 20B, an hydraulic pump drive motor 20C for operating the discharge gate of batch hopper 18 and reclaimer discharge closure 56, a batch hopper discharge gate control solenoid 20D, a reclaimer discharge closure control solenoid 20E, and reclaimer discharge closure closed and open limit switches 20F and 20G, respectively; receiving hopper 22 would have high level probe 22A; bucket elevator 24 would have a drive motor 24A; screening device 26 would have a drive motor 26A; receiving hopper 28 would have a high level probe 28A; conveyor device 30 would have a level probe 30A and a pressure switch 30B; sand bin 32 would have a high level probe 32A; conduit 36 would have a temperature sensor 36A; dust filter 37 would have an exhaust fan drive motor 37A and a temperature sensor 37B; cyclone separator 38 would have a rotary vane drive motor 38A and a temperature sensor 38B; conduit 40 would have a flow control valve 40A and a flow meter 40B; and conduit 42 would have a flow control valve 42A. In order to insure that conduit 36, dust filter 37 and cyclone separator 38 are maintained at a desired temperature, such as about 140° F. to insure against the occurrence of condensation therein under the range of operating conditions of reclaimer 20 to be described, same are preferably wrapped with electrical heating coils 90, 92 and 94, which are then covered with suitable insulating material, not shown. Additional safety and maintenance testing/control devices may be incorporated in system 10, as desired.

To facilitate description of the operation of system 10, it will be assumed that each of motors 20A, 20B, 24A, 26A, 37A and 38A is energized; motor 16A is deenergized; no stand is sensed by probes 14A, 22A, 28A, 30A or 32A; sand is sensed by probes 14B and 18A; heating coils 90, 92 and 94 are energized and conduit 36, cyclone separator 38 and bag filter 37 are at a desired temperature, as sensed by temperature sensors 36A, 37B and 38B, respectively; valves 40A and 42A are closed; switch 30B is on; the discharge gate, not shown, associated with batch hopper 18 is closed; and the discharge closure of reclaimer 50 is in an open condition. Automatic processing of molding sand may commence, if sand is sensed by probe 14B and can be continued absent the sensing of one of the process termination conditions to be described until the absence of sand in bin 14 is sensed by probe 14C; a time delay being provided to permit processing of a predetermined number of additional batches until sand on conveyor 16 and in batch hopper 18 is essentially exhausted. Feeding of molding sand from shakeout device 12 to bin 14 will continue until the supply is exhausted or probe 14A senses a bin filled condition, in which case the supply will be temporarily interrupted. Processed sand may be continuously removed from sand bin 32 at a rate determined by the requirements of mulling device 34 until the sand bin is emptied. Charging of hopper 18 and operation of reclaimer 20 occur simultaneously and at the end of each processing operation or cycle discharge closure 56 is disposed in an open condition.

To initiate a batch processing operation, motor 20C is energized and solenoid 20E deenergized to effect closure of discharge closure 56, whereupon switch 20G is opened or turned off and switch 20F is closed or turned on resulting in deenergization of motor 20C. If probe 18A is on at this point in time, as noted above, motor 20C will be energized and solenoid 20D will be energized to open the gate of batch hopper 18 for purposes of supplying reclaimer container 50 with a batch of molding sand to be processed incident to which switch 18B is opened and switch 18C is closed resulting in deenergization of motor 20C. The batch hopper discharge gate will remain open for some pre-set time, such as 12 to 15 seconds, whereafter motor 20C is energized and solenoid 20D is deenergized to close the gate, which results in switch 18B being turned on and switch 18C turned off, which again stops motor 20C. Thereafter, motor 16A is energized to effect refilling of batch hopper 18 with sand until probe 18A senses that the hopper has been filled, whereupon motor 16A is deenergized.

As soon as switch 18B shows that the batch hopper gate has been closed, which serves as an indication that the reclaimer container 50 has been filled, processing of a batch of molding sand proceeds through one of three operating procedures or paths determined by the operation control computer in accordance with sand temperatures determined by sensor 68. During each of these procedures, reclaimer motors 20A and 20B are continuously energized to effect mixing/attrition of the molding sand and air is continuously withdrawn from reclaimer container 50 by operation of bag filter motor 37A to effect removal of fines, including binder separated from sand grains by attrition, and cooling of the sand due to evaporation of a portion of its moisture content. An exhaust air flow rate of about 800 cubic feet per minute at a velocity of upwards of about 8 feet per second at the inlets of conduits **80*a* and 80*b*** is adequate for batch sizes of 700 to 800 pounds processed in the present reclaimer under the described process conditions to provide for removal of sub sand grain sized binder particles and sufficient quantities of water vapor for expedited sand cooling purposes.

Each procedure commences with the sensing of temperature of the batch of molding sand after container 50 has been rotated a sufficient number of times to insure homogenization of the batch and thus that a stable/accurate temperature reading is obtainable. For example, while generally a stable temperature reading can be obtained in 5 to 6 seconds, it is preferable to delay taking of the reading for about 15 seconds, during which time container 50 undergoes between eight and ten rotations.

If the temperature sensed by sensor 68 is greater than about 120° F., but not more than about 140° F., a first procedure proceeds with continued attrition and air exhaust conditions for a predetermined time period, such as 3 minutes, and is completed by the discharge of the batch from the reclaimer effected by energization of motor 20C and energization of solenoid 20E to effect opening of discharge closure 56, whereupon switch 20F opens and switch 20G closes to effect deenergization of motor 20C. Closure 56 is retained in open condition for some predetermied period of time, such as 15 seconds, to insure that the entire batch is discharged from reclaimer container 50 into receiving hopper 22, whereafter the closure is closed and the next processing cycle initiated in the manner described above, unless the discharged batch is the last batch to be processed in which case motors 20B and 20A are deenergized in succession and after a predetermined time delay to allow purging of the system from molding sand, such as 6 minutes, the system is shut down by shutting down in sequence elevator 24, screen 26, transporter 30, cyclone separator 38 and bag filter 37, which is the reverse of the sequence in which they would have been initially started.

The 3 minute processing period employed in the first procedure, which may vary depending upon the operating conditions of a given foundry, is intended to be sufficient to permit essentially total particulation of sand agglomerates, to maximize the removal of deactivated binder while minimizing the removal of activated binder and to reduce moisture content of the molding sand to a low residual level, whereby to provide fully free flowing molding sand at a reduced temperature level. As by way of example, if it is assumed that a given batch has an initial sensed temperature of 140° F. and a moisture content of about 0.8%, a processing time of 3.25 minutes (15 seconds plus 3 minutes) will be sufficient to provide a discharged batch with a temperature of about 120° F. and moisture content in the general range of 0.3 to 0.4%. While it may be possible to reduce the batch temperature to a much lower level, such as in the range of 75° F. to 80° F., by the evaporation of the entire moisture content of the batch, this is undesirable since excessive processing time would be involved and large amounts of active binder and sand fines would be removed by attrition and lost through the vacuum exhaust system.

If the temperature sensed by sensor 68 is greater than about 140° F., a second procedure will continue with attrition and air exhaust, but unlike the case of the first procedure, the computer control effects opening of valve 40A to permit the addition of water to the batch through nozzle 78 at a uniform controlled rate of for example 1 gallon per minute and for a period of time which increases with an increase in the sensed temperature, whereafter the valve will close. The computer continues to monitor the temperature sensed by sensor 68 and as soon as same has fallen to about 140° F., the process will switch to a 3 minute time cycle, during which the batch is again subjected only to attrition and air exhaust, and then discharged in the manner described in connection with the first procedure. As by way of example, if the sensed temperature of the batch is approximately 195° F. after the initial 15 second mixing cycle, it is known that a substantial portion of the sand contained therein has received substantial heat from the casting and thus has a relatively low moisture content and a substantial amount of deactivated binder. Consequently, there is little available moisture for evaporation/heat dissipating purposes, and thus an exceedingly long processing time would be required to reduce sand temperatures to an acceptable temperature of about 120° F. in the event air flow alone were to be relied upon to cool the sand. Accordingly, water is added to the batch, which upon evaporation greatly shortens the time otherwise required to effect cooling of the sand, without resulting in a residual moisture content differing substantially from that obtainable by the first procedure. The water flow rate is selected to insure that temperatures will be reduced in the shortest period of time without encountering moisture condensation within the exhaust system when maintained at its previously stated temperature. A total cycle time of about 6 minutes minimum would be required to reduce batch temperature from about 195° F. to 120° F., which is divided into 15 seconds for homogenization, 2.5 minutes for water addition, 3 minutes for processing without water addition and 15 seconds for discharge. Due to the extended processing time, more fines will be removed from the batch than in the first procedure, but this is, however, desirable in that it permits removal of a substantial amount of deactivated binder, whose presence is likely due to the heat to which the molding sand had been exposed.

If the temperature sensed by sensor 68 is less than about 120° F., a third procedure will continue with attrition and air exhaust, but in this case the computer control effects opening of valve 42A and operation of a suitable fuel/air ignition device, not shown, for purposes of heating the batch with flames extending from nozzles *76a* and *76b* until batch temperature is determined by sensor 68 to have been raised to a predetermined temperature, e.g. about 140° F., whereupon valve 42A will be closed. The process will then switch to a 3 minute time cycle, during which the batch is again subjected only to attrition and air exhaust, and then discharged in the manner described in connection with the first and second procedures. As by way of example, if the sensed temperature of the batch is approximately 85° F. after the initial 15 second mixing cycle, it is known that a substantial portion of the sand contained in the batch has received little heat from the cast metal or is from a cold mold, and thus has a relatively high moisture content, which would blind screening device 26. While the moisture content of the batch could be reduced by a protected period of attrition and air exhaust, such process would be very inefficient, possibly disrupt the supply of sand to mulling device 34, result in the creation of excessive wear conditions within the reclaimer, and cause high attrition losses with respect to both active binder and sand. Accordingly, to avoid these problems, heat is added to the batch until its temperature is elevated to a point at which a significant partial vapor pressure exists and moisture can be more readily removed by evaporation. A total cycle time of about 4 minutes would be required to increase batch temperature from about 85° F. to 120° F., which is divided into 15 seconds for homogenization, 0.5 minutes of heating to raise the batch temperature to about 140° F., 3 minutes for processing without heat addition, during which time the temperature is reduced to about 120° F., and 15 seconds for discharge. During this procedure, the batch will be elevated to a temperature approximating that of batches processed in accordance with the first and second procedures and will suffer a loss of moisture content sufficient to insure that same is fully free flowing for screening purposes. Damage to active binder within the batch is avoided by controlling the temperature of the heating flames and providing for an elevation in sand temperature to 140° F., which is substantially below the 300° C. temperature at which clay binder begins to become deactivated.

As previously indicated, the presence of certain conditions are intended to arrest automatic operation of system 10 if same should occur during processing. These conditions include the sensing by probe 32A that sand bin 32 is filled; the failure of valve 40A and 42A to timely open or close; the sensing by probe 22A that receiving hopper 22 is full, if the condition persists for some preselected time, such as 5 minutes; the sensing by probe 28A that receiving hopper 28 is full, if the condition persists for some preselected time, such as 1 minute; if probe 30A and switch 30B are both on for some preselected time, such as 4 minutes; if any of motors 24A, 26A, 37A or 38A fail; if motor 16A is energized and probe 18A does not sense a filled condition for batch hopper 18 within some preselected time, such as 2.5 minutes; or if temperature sensor 68 fails.

For each of the three procedures described above, a "target" final batch temperature of about 120° F. has been chosen with a view towards providing a relatively consistent sand input condition for mulling device 34 in order to permit same and thus an automatic molding operation supplied thereby to be operated at maximum efficiency. Any substantial reduction of "target" temperature is undesirable in that reclaimer processing tends to become progressively less efficient, and it is presently contemplated that a commercially practical lower limit would be about 110° F. On the other hand, any substantial increase of "target" temperature is also undesirable from the standpoint that sand compactability begins to fall off sharply above about 120° F. and particularly above 140° F., so as to require progressively longer storage periods for temperature reduction purposes before sand can be supplied to the mulling device without change of the operating condition/efficiency of such device. As a practical matter, in the present system sand can be discharged from reclaimer 20 at temperatures moderately above 120° F. in that sand can be expected to undergo a temperature reduction of 5° F. to 15° F. incident to its subsequent transfer through the system to the mulling device depending on environmental temperature and moisture conditions at the foundry. However, to insure a desired degree of compactability of sand as supplied to the mulling device, it is presently contemplated that the chosen "target" temperature should not be greater than 130° F. and preferably no greater than 125° F. Of course, in that three different procedures may be practiced on batches supplied to reclaimer 20, it is difficult to insure that each batch upon discharge will have the exact temperature, and thus the chosen "target" temperature is an approximate temperature from which actual discharge sand temperature may vary through some pre-established range of for example plus or minus 5° F. to 10° F. Further, it will be understood that the processing times and temperatures are given by way of specific example only, since same will necessarily require adjustment dependent on the geographical location of the foundry, as well as possibly the season of the year during which the system is in operation. In view of these variables involved i tailoring the system for use under different foundry conditions, it is important to note that the most critical condition required of the system is that the reclaimer serves to supply fully free flowing sand under relatively consistent temperature conditions, which enables the processed sand to be used by a mulling device without requiring an additional or intermediate cooling operation to be performed other than that incident to transfer of sand between the reclaimer and mulling device via a screening device and a sand bin acting primarily as a surge compensating device, which provides for uniform supply to the mulling device in spite of variations in processing time of sand within the reclaimer, regardless of variations in temperature and moisture content conditions of sand supplied to the reclaimer.

What is claimed is:

1. A process for reclaiming green sand including:
successively presenting portions of said sand to a reclaiming unit;
sensing the initial temperature of each said portion presented to said unit; and
selectively subjecting each said portion within said unit to attrition and cooling by the exhaust of air and water vapor from said unit when said initial temperature is within the range of about 120° F. to 140° F. until the temperature of said portion is reduced to about 120° F. and said portion is free flowing, or to cooling by the addition of water when said initial temperature is above about 140° F. until the temperature of said portion is reduced to about 140° F. and to attrition and cooling by exhaust of air and water vapor from said unit until the temperature of said portion is reduced to about 120° F. and is free flowing, or to heating to raise the temperature of said portion to about 140° F. when said initial temperature is below about 120° F. and to attrition and cooling by exhaust of air and water vapor from said unit until the temperature of said portion is reduced to about 120° F. and said portion is free flowing.

2. The process according to claim 1 including the step of conducting said air and water vapor exhausted from said unit through a conduit to means for separating dust from said air, and controlling the temperature of said conduit and means, flow rate of said air and the rate of addition of said water to said unit to prevent the occurrence of condensation in said conduit and means.

3. A process for reclaiming green sand including:
successively presenting portions of said green sand to a reclaiming unit;
sensing the initial temperature of each said portion presented to said unit, and if said initial temperature is below about 120° F., elevating the temperature of said portion to about 140° F. and subjecting said portion to attrition and cooling by the exhaust of air and water vapor from said unit until the temperature of said portion is reduced to about 120° F. and said portion is free flowing.

4. A process for reclaiming green said including:
successively presenting portions of said green sand to a reclaiming unit;
sensing the initial temperature of each said portion presented to said unit, and if said initial temperature is above about 140° F., cooling said portion by adding water to said unit until the temperature of said portion is reduced to about 140° F. and subjecting said portion to attrition and cooling by exhaust of air and water vapor from said unit until the temperature of said portion is reduced to about 120° F.

5. A process for reclaiming green sand supplied under non-uniform temperature and moisture content conditions, as a result of variations in mold temperature conditions to which said sand was exposed during foundry operations, wherein moisture content of said sand tends to vary inversely with the temperature thereof, said process including:
successively presenting portions of said sand to a single reclaimer;
sensing the initial temperature of each said portion presented to said reclaimer; and
selectively subjecting each said portion within said reclaimer to attrition and cooling by the exhaust of air and water vapor from said reclaimer when said initial temperature is within a preselected temperature range within which sufficiently high partial vapor pressure conditions exist to facilitate evaporation of moisture from said sand for sand cooling purposes until the temperature of said portion is reduced to a temperature adjacent a lower end of said temperature range and said portion is free flowing for screening purposes, or to cooling by the addition of water when said initial temperature is above said temperature range until the temperature of said portion is reduced to within said temperature range and to attrition and cooling by exhaust of air and water vapor from said reclaimer until the temperature of said portion is reduced to a temperature adjacent said lower end of said temperature range and is free flowing for screening purposes, or to heating to raise the temperature of said portion to a temperature adjacent an upper end of said temperature range when said initial temperature is below said temperature range and to attrition and cooling by exhaust of air and water vapor from said reclaimer until the temperature of said portion is reduced to a temperature adjacent said lower end of said temperature range and said portion is free flowing for screening purposes.

6. The process according to claim 5, wherein said temperature range is about 120° F. to 140° F.

7. The process according to claim 5, wherein each said portion is free flowing for screening purposes through a 20 mesh screen.

8. A process for reclaiming green sand supplied under non-uniform temperature and moisture content conditions, as a result of variations in mold temperature conditions to which said sand was exposed during foundry operations, wherein moisture content of said sand tends to vary inversely with temperature thereof, said process including:
dividing said sand into batches of sand;
sensing the initial mean temperature of each of said batches; and
successively and variably processing said batches in a single sand reclaimer container in accordance with the sensed initial mean temperature thereof to provide said batches with a relatively uniform final temperature not exceeding about 120° F. and final moisture content permitting same to be free flowing for screening purposes.

9. A process according to claim 8, wherein said batches are successively processed by continuously subjecting said batches to attrition and to flow of air for withdrawing from said reclaimer container particles generated by attrition and moisture vapor generated by evaporation of moisture present within said reclaimer container, further subjecting any of said batches having an initial mean temperature above about 140° F. to the addition of water to supplement any moisture initially present therein, and further subjecting any of said batches having an initial mean temperature below about 120° F. to heat sufficient to increase the temperature of the last said batches to provide a vapor pressure condition within said reclaimer container sufficiently high to facilitate evaporation of moisture therein.

* * * * *